US006193188B1

(12) United States Patent
Ahmad et al.

(10) Patent No.: US 6,193,188 B1
(45) Date of Patent: Feb. 27, 2001

(54) LINE OF SIGHT POINTING MECHANISM FOR SENSORS

(75) Inventors: Anees Ahmad, Tucson; Thomas D. Arndt, Amado, both of AZ (US)

(73) Assignee: Raytheon Company, Lexington, MA (US)

( * ) Notice: Under 35 U.S.C. 154(b), the term of this patent shall be extended for 0 days.

(21) Appl. No.: 09/190,954

(22) Filed: Nov. 12, 1998

(51) Int. Cl.[7] ..... F41G 7/00; F42B 10/00

(52) U.S. Cl. ..... 244/3.16; 244/3.15; 244/75 R; 244/117 R; 244/119; 244/121; 244/129.1; 244/129.3; 342/61; 342/63

(58) Field of Search ..... 244/3.15–3.19, 244/3.2, 3.21, 3.22, 75 R, 76 R, 175, 176, 177, 78, 79, 80, 96, 117 R, 119–121, 129.1, 129.3; 342/52–56, 61, 62, 73, 74; 343/705, 708, 711, 712, 713, 714, 718, 872, 873; 250/201.1, 203.1

(56) References Cited

U.S. PATENT DOCUMENTS 4,210,804 * 7/1980 LaTorre et al. ..... 250/203.1

* cited by examiner

*Primary Examiner*—Bernarr E. Gregory
(74) *Attorney, Agent, or Firm*—David W. Collins; Andrew J. Rudd; Glenn H. Lenzen, Jr.

(57) ABSTRACT

A missile includes a fuselage with a roll axis and a nod axis perpendicular to the roll axis, and a conformal window mounted to a forward-facing end of the fuselage. There is a sensor system with a field of regard through the window and a line of sight, and a sensor system pointing mechanism affixed to the airframe and upon which the sensor system is supported. The sensor system pointing mechanism includes a gimbal structure having a first degree of rotational freedom about the roll axis and a second degree of rotational freedom about the nod axis, and a linear translational mechanism connected to the sensor system. The linear translational mechanism is operable to translate the sensor system away from the window with increasing angular deviation of the line of sight of the sensor system from the roll axis. Preferably, the translational mechanism is a slider-crank mechanism.

17 Claims, 4 Drawing Sheets

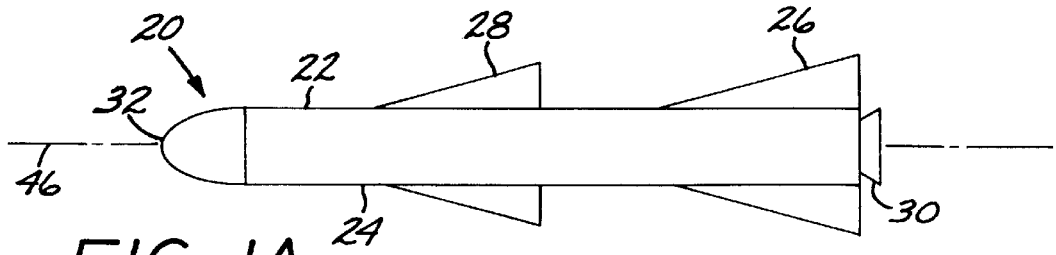
FIG. 1A
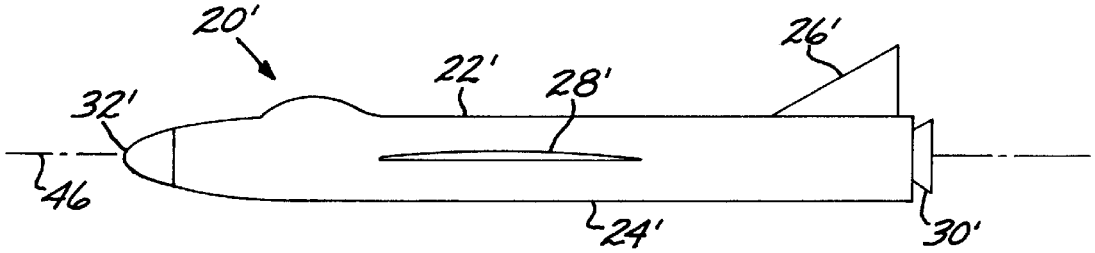
FIG. 1B
FIG. 2
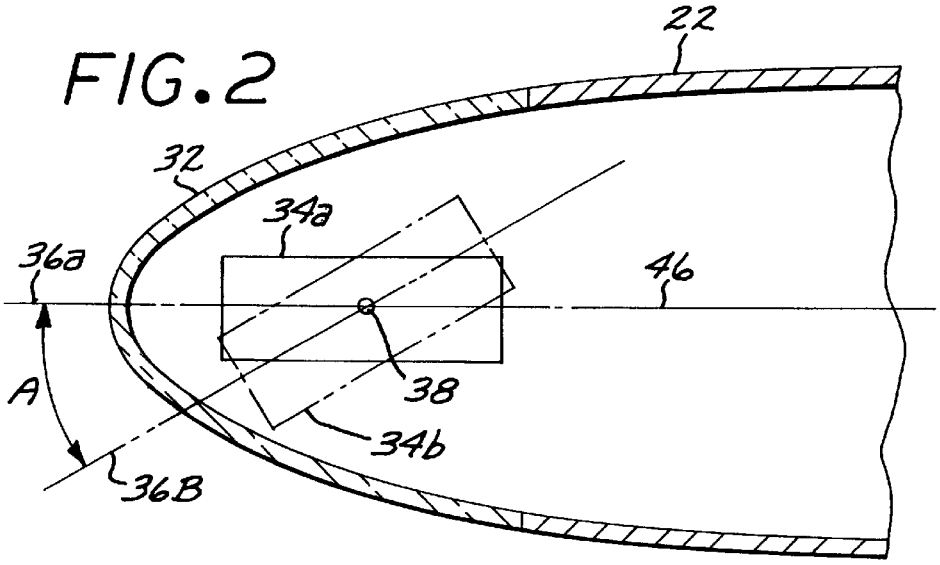

LINE OF SIGHT POINTING MECHANISM FOR SENSORS

BACKGROUND OF THE INVENTION

This invention relates to sensors used in flight vehicles, and, more particularly, to a pointing mechanism for sensors used with conformal windows.

Optical sensors are used in aircraft and missile applications to receive radiated energy from a scene and convert it to an electrical signal. The electrical signal is provided to a display or further processed for pattern recognition or the like. The optical sensor and its related optical train, termed a sensor system, are usually packaged in an elongated housing. The sensor may be pivotably mounted within the airframe to allow the optical sensor to be pointed toward subjects of interest.

The sensor system is rather fragile and is easily damaged by dirt, erosion, chemicals, or high air velocity. The sensor system is therefore placed behind a window through which the sensor views the scene and which protects the sensor system from such external agents. The window must be transparent to the radiation of the operating wavelength of the sensor, resist attack from the external forces, and minimally distort the image received by the sensor. The window must also permit the sensor to view the scene over the specified field of regard, which is the specified angular extent over which the sensor must be able to view the scene.

For many applications such as low-speed aircraft and helicopters, the window may be spherical in shape, with the sensor pivot point placed at the center of the sphere to minimize line-of-sight-dependent distortion of the image. However, in higher speed aircraft and missiles the spherical window is unsatisfactory, as it induces a great deal of aerodynamic drag that reduces the maximum speed and range of the vehicle. An elongated, relatively narrow window, termed a conformal window, is therefore preferred for use in high-speed applications to reduce the aerodynamic drag.

The elongated telescope of the sensor system may easily fit within the elongated conformal window when the line of sight of the sensor system lies parallel or nearly parallel to the direction of elongation of the conformal window. If the telescope is pivoted so that the line of sight points at a greater angle to the direction of elongation of the conformal window, the telescope of the sensor system may contact against the inside surface of the window and prevent further movement. One design approach to increasing the allowable pointing angle is to make the elongated telescope of the sensor system and its optics smaller in diameter, but this design variation reduces the aperture size and thence the energy-gathering capability of the sensor system.

There is a need for an improved approach to sensor systems used with conformal windows, which allows the sensor system to be pointed to large line-of-sight pointing angles within the spatial envelope of a conformal window. The present invention fulfills this need, and further provides related advantages.

SUMMARY OF THE INVENTION

The present invention provides a flight vehicle, either a manned vehicle or an unmanned missile, with a sensor system protected by a window such as a conformal window. A pointing mechanism points the sensor system to a desired line-of-sight angle. The pointing mechanism of the invention allows the sensor system to be pivoted to large line-of-sight pointing angles within the available spatial envelope of the conformal window than possible with prior pointing mechanisms. Little weight is added to the structure with the present pointing mechanism, and the size of the optical aperture of the sensor system need not be reduced. Large-aperture sensor systems may therefore be used with conformal windows and pointed to large line-of-sight pointing angles to provide the sensor system with a high field of regard.

In accordance with the invention, a flight vehicle such as a high-speed missile comprises an airframe, a window mounted to the airframe, a sensor system with a field of regard through the window, and a sensor system pointing mechanism supported on the airframe. The sensor system pointing mechanism includes a gimbal structure upon which the sensor system is supported and having at least one rotational degree of movement, and a translational mechanism operable to linearly translate the sensor system in a controllable manner.

In a preferred application, the window is a forward-facing, generally conical or ogival, elongated conformal window that narrows to a closed, pointed forward end and has a relatively large rear end that attaches to the airframe. When the sensor system is pointed forward with a zero or small line-of-sight pointing angle relative to the axis of elongation of the conformal window, the sensor system is positioned as far forwardly as it can reach without contacting the closed end of the window. As the sensor system is pivoted to increasing line-of-sight pointing angles, the sensor system is linearly translated rearwardly into the relatively larger-diameter portion of the conformal window, so that there is more room to accomplish the pivoting to a large angular deviation from the axis of elongation of the conformal window.

Any operable mechanical device may be used to provide the combination of rotational and linear movements. Preferably, the pointing mechanism comprises a slider-crank-type mechanism. There is a pin support on one part of the sensor system and the translational mechanism, and a slot on the other part of the sensor system and the translational mechanism, with the pin support being engaged to the slot. A pivoting drive link extends between the sensor system and the translational mechanism at a position remote from the engagement of the pin support and the slot, whereby rotation of the drive link rotates the sensor system relative to the translational mechanism and also linearly translates the pin support in the slot. The dimensions and linkage lengths of the pointing mechanism may be selected as necessary for various sizes and shapes of the sensor system and the window.

A single motor is operably connected to the pivoting drive link to cause it to rotate, thence providing both the rotation and linear movements. The use of a single motor, rather than two motors (one for translation and one for rotation), is an important advantage of the present invention. The use of a single motor reduces weight, power consumption, and the number of wires that must extend between the stationary airframe and the movable gimbal, and has lower cost. An angular measuring device, such as a resolver or a potentiometer connected to the motor axis, provides feedback data to control the degree of angular deviation.

The present approach allows the sensor system to be optimally positioned for small pointing angles and for larger pointing angles as well, so that the sensor system may have a large field of regard and good optical performance. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 1A is an elevational view of an unmanned missile, and FIG. 1B is an elevational view of a manned aircraft;

FIG. 2 is a schematic sectional view of the conformal window and sensor system positioned in relation to the conformal window for two lines of sight;

FIGS. 3A–3C are views of a first embodiment of the approach of the invention, wherein FIG. 3A is a top view, FIG. 3B is a side view with the sensor system pointed at a 0 degree line of sight nod angle, and FIG. 3C is a side view with the sensor system pointed at a 35 degree line of sight nod angle;

FIGS. 4A–4C are views of a second embodiment of the approach of the invention, wherein FIG. 4A is a top view, FIG. 4B is a side view with the sensor system pointed at a 0 degree line of sight nod angle, and FIG. 4C is a side view with the sensor system pointed at a 35 degree line of sight nod angle; and FIGS. 5A–5C are views of a third embodiment of the approach of the invention, wherein FIG. 5A is a top view, FIG. 5B is a side view with the sensor system pointed at a 0 degree line of sight nod angle, and FIG. 5C is a side view with the sensor system pointed at a 35 degree line of sight nod angle.

DETAILED DESCRIPTION OF THE INVENTION

Figure 3A:
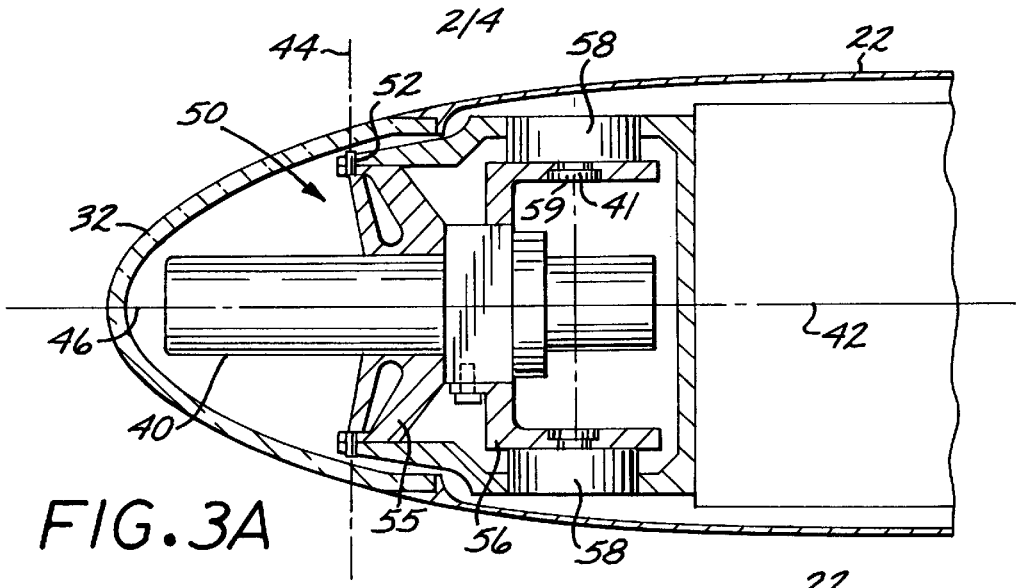

The present invention is preferably utilized in conjunction with a sensor system used on a flight vehicle such as an unmanned missile 20 of FIG. 1A. The missile 20 has an airframe 22, including in this case a fuselage 24, tail fins 26. and guidance tins 28. A rocket motor 30 is positioned in a tail of the fuselage 24. At a forward end of the fuselage 24 and supported on the airframe 22 is a forward-facing window 32 through which a sensor system views an external scene. In this case, the window 32 is a conformal window having an ogival shape, but which could also be conical or other non-spherical shape. FIG. 1B illustrates a manned aircraft 20' having similar elements, including a fuselage 24', a tail 26', wings 28', a jet engine 30', and a forward-facing conformal window 32'. The preferred application of the present invention is on the missile 20, and the following discussion will be directed toward such a missile. The invention is not limited to the illustrated missile 20, but is equally applicable to the aircraft 20', other missiles, and other operable structures.

FIG. 2 depicts an interior view of the nose of the missile 20, with a gimbaled sensor system 34 schematically shown and illustrating a problem encountered in the conventional approach. The sensor system 34 may be of any operable type, such as a visible-light sensor or an infrared sensor, with appropriate optical elements. Such sensor systems are known in the art.

When the line of sight 36 of the sensor system 34 is pointed directly forwardly as indicated at 34*a* and 36*a*, it fits easily within the available spatial envelope of the conformal window 32. However, when the sensor system is pivoted about its pivot point 38 so that its line of sight 36*b* is pointed at a sufficiently great nod angle A (illustrated as about 25 degrees), the sensor system 34*b* contacts the inside surface of the conformal window 32 and cannot pivot to greater nod angles. The maximum nod angle A could be increased by making the sensor system 34 of smaller diameter, but that solution would reduce the light-gathering capability of its optics (i.e., a smaller optical aperture).

In many cases, system specifications require a greater maximum nod angle A, on the order of about 35 degrees or so, without increasing the axial length of the missile compartment that is available for containing the sensor system 34. With the conventional approach illustrated in FIG. 2, either the maximum nod angle A cannot be increased to the desired value, or the optical aperture of the sensor system must be reduced. The present invention provides a mechanical structure that allows a greater nod angle without reduction of the aperture.

FIGS. 3A–5C illustrate three embodiments of the present invention, and the following discussion is generally applicable to all three embodiments except where otherwise indicated. The same terminology and reference numerals will be applied to the three embodiments. The views presented for the three embodiments are the same, with the -A view being a top view, the -B view being a side view with a zero nod angle, and the -C view being a side view with the sensor system rotated to a nod angle of about 35 degrees.

The sensor system 34 includes a telescope assembly 40, which contains the optics (lenses and/or mirrors) that gather and focus optical energy, and a sensor which receives the optical energy and converts it to electrical signals. The telescope assembly 40 is mounted to a "roll/yaw" type gimbal 41 having two degrees of freedom, which permits the telescope assembly 40 to rotate about a roll axis 42 and also about a nod axis 44. The roll axis 42 in this case of the forwardly facing sensor system 34 is coincident with a longitudinal axis 46 of the fuselage 24. These two degrees of rotational freedom permit the telescope assembly 40 to be pointed in any generally forwardly facing direction up to the maximum nod angle A. The "roll/yaw" gimbal is illustrated, but the present approach is equally applicable to other types of gimbal structures such as those which rotate about x and y transverse axes.

A translational mechanism 50 is provided to linearly translate the telescope assembly 40 of the sensor system 34 in a controllable manner between a first location and a second location along the roll axis 42. This linear translation of a portion of the sensor system 34 between different locations along the roll axis 42 is to be distinguished from rotational movement of a portion of the sensor system 34 about the roll axis 42 and the nod axis 44. The linear translation is performed to move the telescope assembly 40 rearwardly as the nod angle A increases. That is, the telescope assembly 40 is in its forwardmost position when the line of sight is directly forward (nod angle A of zero), and moves rearwardly as the line of sight angle deviation (increasing nod angle) from the roll axis 44 (and thence longitudinal axis 46) increases.

The translational mechanism is preferably of the slider-crank type. That is, a rotational element causes the telescope assembly 40 to rotate about the nod axis 44 under command, and a mechanical constraint simultaneously allows the telescope assembly 40 to translate linearly with a linear component parallel to the roll axis 42. With increasing nod angle A, the telescope assembly 40 moves linearly rearwardly, and with decreasing nod angle A, the telescope assembly 40 moves linearly forwardly. These movements allow the telescope assembly 40 to pivot to greater nod angles A in the same length of available fuselage, than possible without the linear rearward movement. This type of a mechanism may be implemented in a number of embodiments, three of which are discussed next. However, it is to be understood that a key feature of the invention lies in the fact of the linear translation occurring in a controlled manner simultaneously with the nodding rotation, not in the specific mechanical structure utilized to accomplish the simultaneous movement.

Figure 3B:
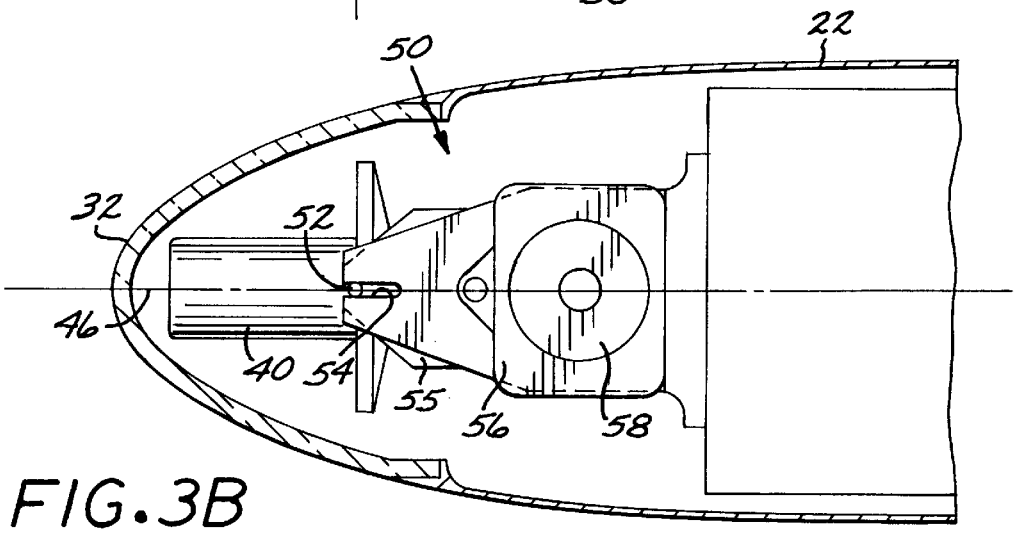
Figure 3C:
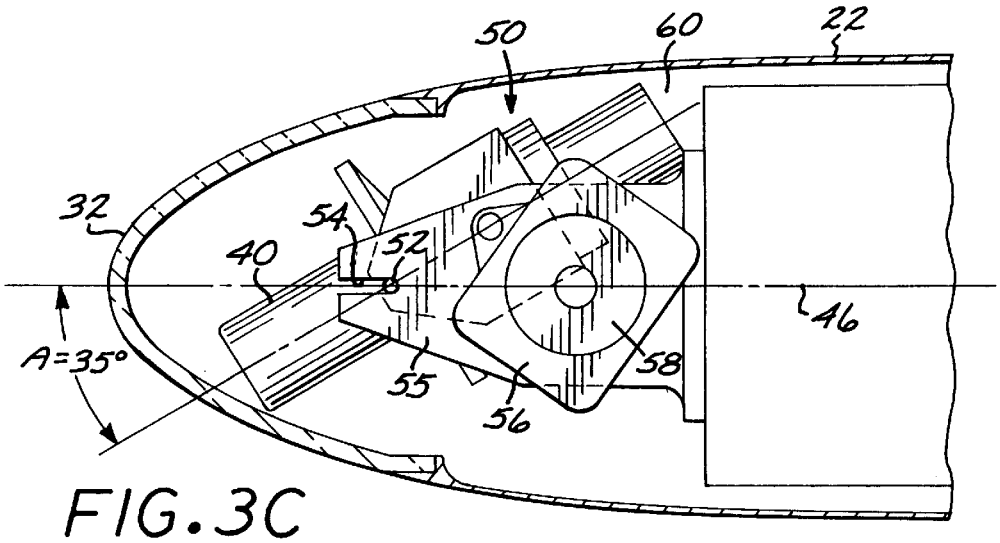

In the embodiment of FIGS. 3A–C, a pin 52 extends outwardly on each side of the telescope assembly. Each of the two pins 52 engages a slot 54 in a stationary housing 55 of the translational mechanism 50. A drive link 56 is pivotably connected to the telescope assembly 40 at a location remote from the pins 52, and a single motor 58 having a motor axis provides rotational movement to the drive link 56. FIG. 3B illustrates in side view the sensor system 34 and the translational mechanism 50 when the nod angle A is zero. As the drive link 56 is rotated by the motor 58, clockwise in FIG. 3C, the telescope assembly 40 rotates in the opposite direction, counterclockwise in FIG. 3C, to an increasing nod angle A. This angular motion is measured by an angular measurement device 59 connected to the motor axis, such as a resolver or potentiometer, whose output is used as a control signal for the motor 58 to establish the magnitude of the degree of rotation of the motor axis. At the same time, the pins 52 are drawn rearwardly in the slots 54, thereby linearly translating the telescope assembly 40 rearwardly, as a comparison of the position of the pins 52 in the stationary slots 54 of FIGS. 3B and 3C shows. This rearward movement of the telescope assembly 40 allows the rearward end of the telescope assembly 40 to move into and utilize what otherwise would be unused space at the sides of the rearward end of the available compartment 60, while also allowing the forward end of the telescope assembly 40 to pivot to a larger nod angle A than possible in the absence of such rearward movement. The available field of regard of the sensor system 34 is therefore larger than would otherwise be the case. This movement is equivalent to a slider-crank mechanism with fixed link lengths.

Figure 4A:
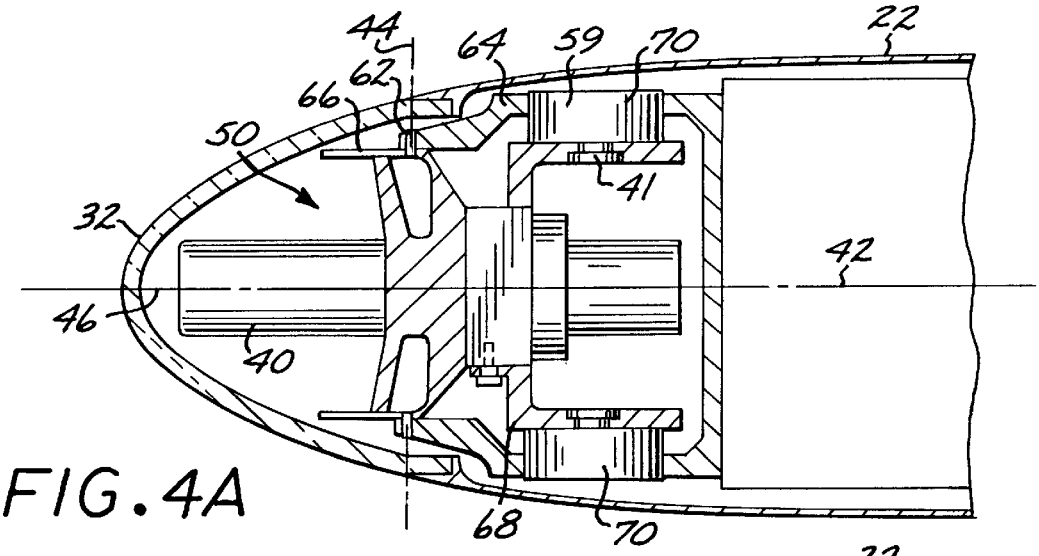
Figure 4B:
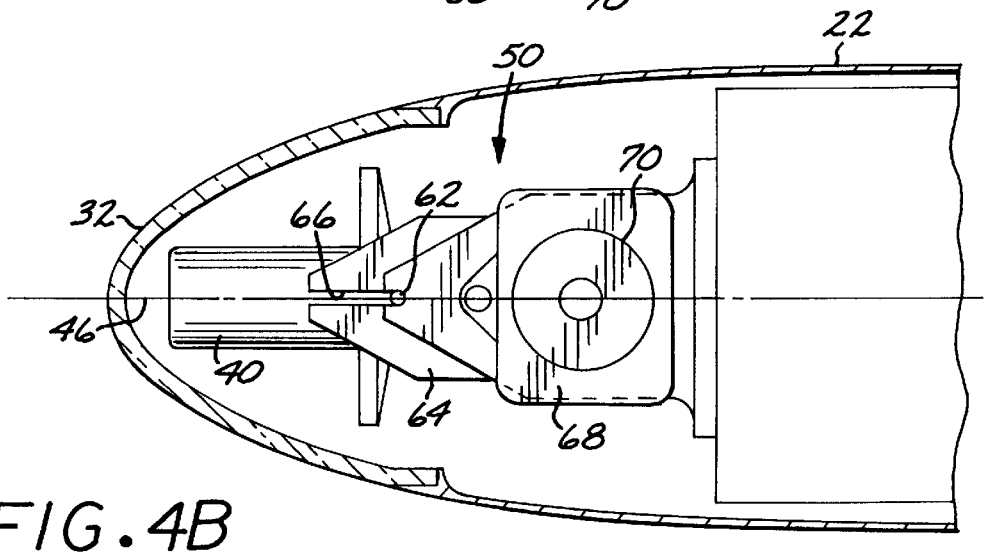
Figure 4C:
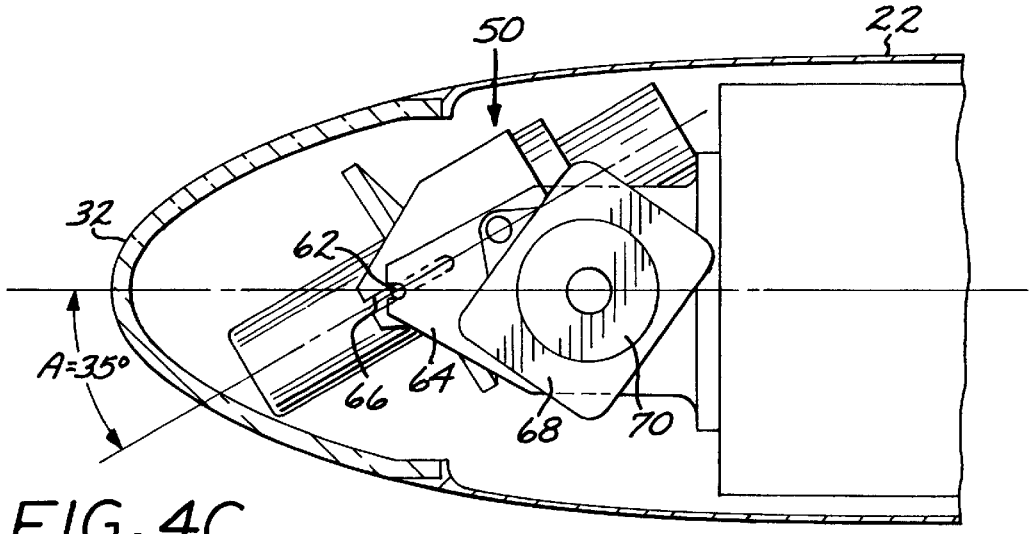

In the embodiment of FIGS. 4A–4C, the guide pins 62 extend inwardly from a pivotable telescope housing 64, and the slot 66 is in the telescope assembly 40. A drive link 68 is rotationally driven by a motor 70 having a motor axis. Rotation of the drive link 68 by the motor 70 causes the telescope assembly 40 to rotate and simultaneously translate linearly rearwardly, as seen by comparing the position of the pins 62 in the slot 66 in FIGS. 4B and 4C. This angular motion is measured by the angular measurement device 59 connected to the motor axis, such as a resolver or potentiometer, whose output is used as a control signal for the motor 70 to establish the magnitude of the degree of rotation of the motor axis. This movement is equivalent to a slider-crank mechanism that has a fixed base length but a coupler link whose length varies to draw the telescope assembly 40 rearwardly with increasing rotation.

Figure 5A:
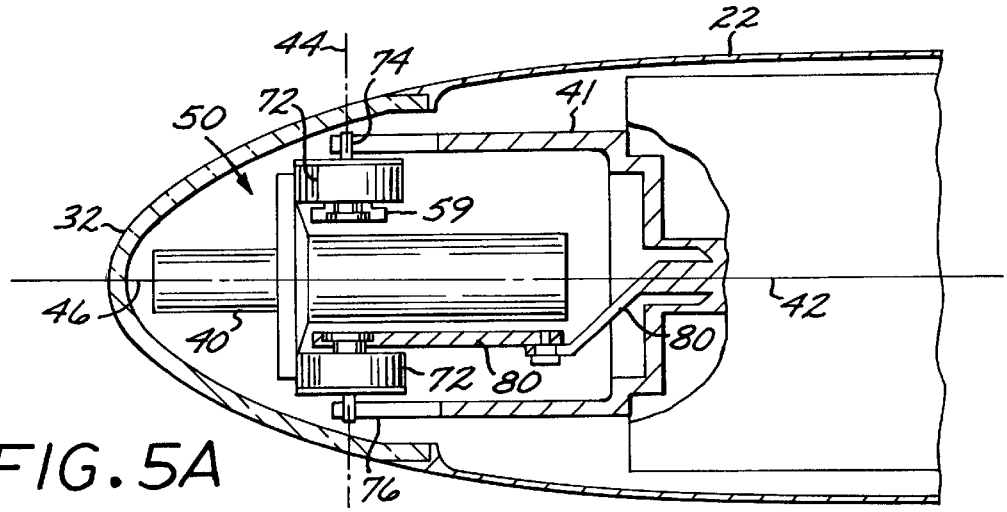
Figure 5B:
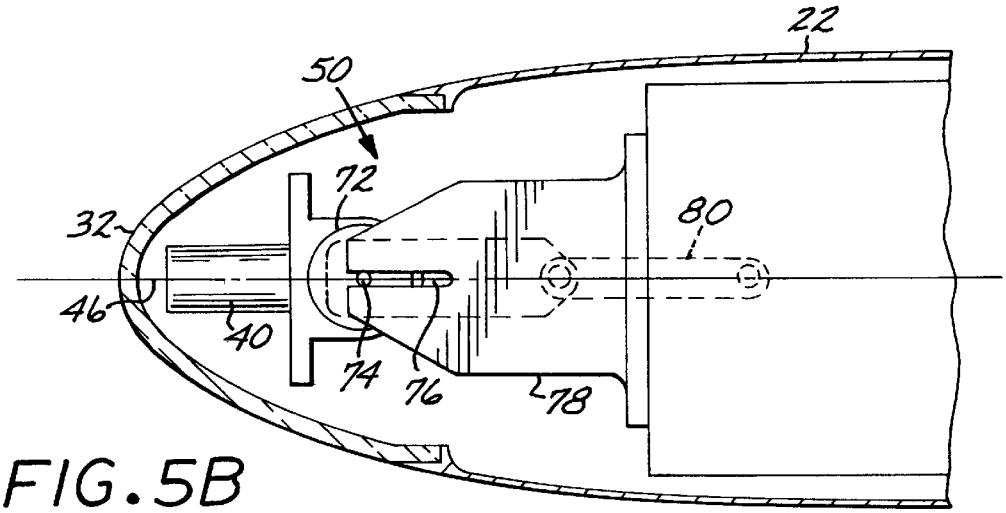
Figure 5C:
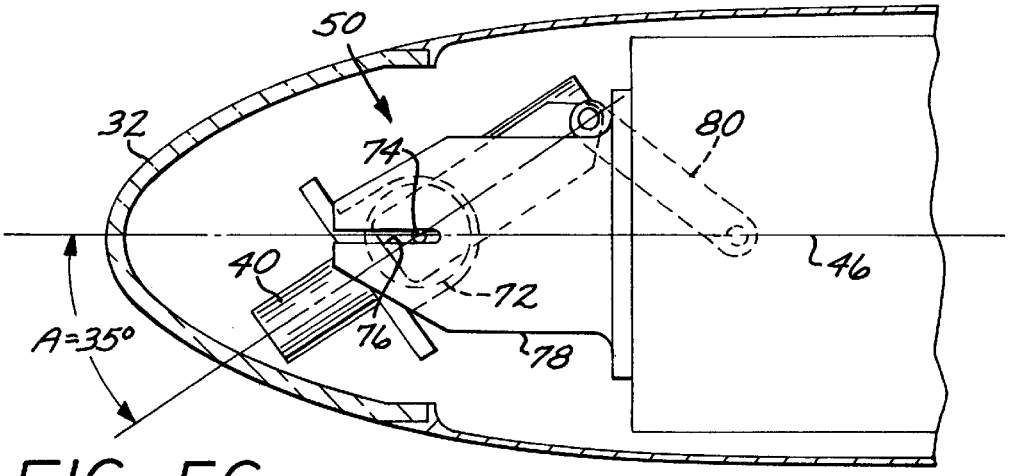

In the embodiment of FIGS. 5A–5C, a motor 72 having a motor axis is integral with the telescope assembly 40, and the guide pins 74 extend outwardly from the motor 72. The nod axis 44 is the same as the axis of rotation of the motor 72. The guide pins 74 engage respective slots 76 in a stationary housing 78. The motor 72 is coupled to the stationary housing 78 by a link 80 of fixed length. As the motor 72 rotates the telescope assembly 40 to increasing nod angle A, as seen in FIGS. 5B and 5C, the motor force reacts through the link 80 to draw the telescope assembly 40 rearwardly under the constraint of the guide pins 74 sliding in the slots 76. This angular motion is measured by the angular measurement device 59 connected to the motor axis, such as a resolver or potentiometer, whose output is used as a control signal for the motor 72 to establish the magnitude of the degree of rotation of the motor axis. As in the embodiments of FIGS. 3 and 4, the telescope assembly 40 of the sensor system 34 more efficiently utilizes the available space in the compartment, allowing pivoting of the telescope assembly 40 to a greater nod angle A than would otherwise be the case.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A flight vehicle, comprising:

an airframe;

a window mounted to the airframe;

a sensor system with a field of regard through the window, the sensor system comprising a telescope assembly having optics that gather and focus optical energy; and a telescope-assembly pointing mechanism supported on the airframe and comprising a gimbal structure upon which the telescope assembly is supported and having at least one rotational degree of movement, and a translational mechanism which linearly translates the telescope assembly in a controllable manner.

2. The flight vehicle of claim 1, wherein the flight vehicle is an unmanned missile.

3. The flight vehicle of claim 1, wherein the flight vehicle is a manned aircraft.

4. The flight vehicle of claim 1, wherein the airframe comprises a fuselage, wherein the window is affixed to the fuselage, and wherein the sensor system and pointing mechanism are located within the fuselage.

5. The flight vehicle of claim 1, wherein the sensor system comprises an optical sensor.

6. The flight vehicle of claim 1, wherein the translational mechanism comprises a slider-crank mechanism.

7. The flight vehicle of claim 1, wherein the telescope-assembly pointing mechanism includes a pin support on one of the telescope assembly and the translational mechanism, a slot on the other of the telescope assembly and the translational mechanism, the pin support being engaged to the slot, a pivoting drive link extending between the telescope assembly and the translational mechanism at a position remote from the engagement of the pin support and the slot, whereby rotation of the drive link rotates the telescope assembly relative to the translational mechanism and also linearly translates the pin support in the slot, a motor having a motor axis, the motor being connected to the pivoting drive link to cause it to rotate, and an angular measurement device connected to the motor axis to measure a degree of rotation of the motor axis.

8. A flight vehicle, comprising:

an airframe;

a window mounted to the airframe;

a sensor system with a field of regard through the window and a line of sight, the sensor system comprising a telescope assembly having optics that gather and focus optical energy;

a telescope-assembly pointing mechanism affixed to the airframe and upon which the telescope assembly is supported, the telescope-assembly pointing mechanism comprising a gimbal structure having a first degree of rotational freedom about a roll axis and a second degree of rotational freedom about a nod axis lying perpendicular to the roll axis, and a translational mechanism which linearly translates the telescope assembly between a first location and a second location along the roll axis.

9. The flight vehicle of claim 8, wherein the airframe includes a fuselage with a fuselage axis of elongation, wherein the window is mounted to a forward end of the fuselage, and wherein the roll axis of the gimbal structure coincides with the fuselage axis of elongation.

10. The flight vehicle of claim 9, wherein the translational mechanism moves the telescope assembly away from the window with increasing angular deviation of the line of sight of the telescope assembly from the roll axis.

11. The flight vehicle of claim 8, wherein the translational mechanism comprises a slider-crank mechanism.

12. The flight vehicle of claim 8, wherein the telescope-assembly pointing mechanism includes a pin support on one of the telescope assembly and the translational mechanism, a slot on the other of the telescope assembly and the translational mechanism, the pin support being engaged to the slot, a pivoting drive link extending between the telescope assembly and the translational mechanism at a position remote from the engagement of the pin support and the slot, whereby rotation of the drive link rotates the telescope assembly relative to the translational mechanism and also linearly translates the pin support in the slot, a motor having a motor axis, the motor being connected to the pivoting drive link to cause it to rotate, and an angular measurement device connected to the motor axis to measure a degree of rotation of the motor axis.

13. A flight vehicle, comprising:

an airframe including a fuselage having a roll axis coincident with a longitudinal axis of the airframe and a nod axis perpendicular to the roll axis;

a conformal window mounted to a forward-facing end of the airframe;

a sensor system with a field of regard through the window and a line of sight, the sensor system comprising a telescope assembly having optics that gather and focus optical energy;

a telescope-assembly pointing mechanism affixed to the airframe and upon which the telescope assembly is supported, the telescope-assembly pointing mechanism comprising a gimbal structure having a first degree of rotational freedom about the roll axis and a second degree of rotational freedom about the nod axis, and a linear translational mechanism connected to the telescope assembly, the linear translational mechanism translating the telescope assembly away from the window with increasing angular deviation of the line of sight of the telescope assembly from the roll axis.

14. The flight vehicle of claim 13, wherein the translational mechanism comprises a slider-crank mechanism.

15. The flight vehicle of claim 13, wherein the telescope-assembly pointing mechanism includes a pin support on one of the telescope assembly and the translational mechanism, a slot on the other of the telescope assembly and the translational mechanism, the pin support being engaged to the slot, a pivoting drive link extending between the telescope assembly and the translational mechanism at a position remote from the engagement of the pin support and the slot, whereby rotation of the drive link rotates the telescope assembly relative to the translational mechanism and also linearly translates the pin support in the slot, a motor having a motor axis, the motor being connected to the pivoting drive link to cause it to rotate, and an angular measurement device connected to the motor axis to measure a degree of rotation of the motor axis.

16. The flight vehicle of claim 15, wherein the pin support is on the sensor system and the slot is on the translational mechanism.

17. The flight vehicle of claim 15, wherein the pin support is on the translational mechanism and the slot is on the telescope assembly.

* * * * *